US008419158B2

(12) United States Patent
Jeong et al.

(10) Patent No.: US 8,419,158 B2
(45) **Date of Patent: *Apr. 16, 2013**

(54) APPARATUS TO SENSE TEMPERATURE OF INK-JET HEAD

(75) Inventors: Yong-won Jeong, Seoul (KR); Hyung Choi, Seongnam-si (KR); Eun-bong Han, Suwon-si (KR); Yong-seop Yoon, Seoul (KR); Moon-chul Lee, Seongnam-si (KR); Dong-sik Shim, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 499 days.

This patent is subject to a terminal disclaimer.

(21) Appl. No.: 12/139,652

(22) Filed: Jun. 16, 2008

(65) Prior Publication Data

US 2009/0194025 A1 Aug. 6, 2009

(30) Foreign Application Priority Data

Feb. 1, 2008 (KR) ..... 10-2008-0010818

(51) Int. Cl.
*B41J 29/393* (2006.01)

(52) U.S. Cl.
USPC ..... 347/19; 347/17

(58) Field of Classification Search ..... None
See application file for complete search history.

(56) References Cited

U.S. PATENT DOCUMENTS

| | | | | |
|---|---|---|---|---|
| 4,791,435 | A | 12/1988 | Smith et al. | |
| 4,899,180 | A | 2/1990 | Elhatem et al. | |
| 5,075,690 | A | 12/1991 | Kneezel | |
| 5,485,182 | A | 1/1996 | Takayanagi et al. | |
| 5,745,130 | A | 4/1998 | Becerra et al. | |
| 6,270,180 | B1 * | 8/2001 | Arakawa et al. | 347/14 |
| 6,292,050 | B1 * | 9/2001 | Dooley et al. | 327/540 |
| 6,945,629 | B2 | 9/2005 | Yamaguchi et al. | |
| 7,131,714 | B2 | 11/2006 | Edelen et al. | |
| 2002/0027574 | A1 * | 3/2002 | Kao et al. | 347/17 |
| 2007/0058310 | A1 * | 3/2007 | Fan et al. | 361/90 |
| 2007/0105301 | A1 * | 5/2007 | Chen et al. | 438/234 |
| 2008/0192804 | A1 * | 8/2008 | Ryu | 374/178 |
| 2010/0002036 | A1 * | 1/2010 | Jeong et al. | 347/14 |

* cited by examiner

*Primary Examiner* — Matthew Luu
*Assistant Examiner* — Justin Seo
(74) *Attorney, Agent, or Firm* — Stanzione & Kim, LLP

(57) ABSTRACT

An apparatus to sense the temperature of an ink-jet head includes at least one or more CMOS (complementary metal oxide semiconductor) lateral BJTs (bipolar junction transistors) to sense the temperature of the ink-jet head, and a current supply unit to supply a current to the CMOS lateral BJTs. Minimum sized CMOS lateral BJTs are applied to an ink-jet printer head so that precise temperature control can be performed in a shuttle or array type ink-jet printer.

13 Claims, 5 Drawing Sheets

APPARATUS TO SENSE TEMPERATURE OF INK-JET HEAD

CROSS-REFERENCE TO RELATED APPLICATIONS

This application claims priority under 35 U.S.C. §119(a) from Korean Patent Application No. 10-2008-0010818, filed on Feb. 1, 2008, in the Korean Intellectual Property Office, the disclosure of which is incorporated herein in its entirety by reference.

BACKGROUND OF THE INVENTION

1. Field of the Invention

The present general inventive concept relates to an apparatus to sense the temperature of a hyperfine/high resolution ink-jet head so as to precisely control the temperature of micro-parts such as a precision machine/a micro-electro-mechanical systems (MEMS) chip, etc.

2. Description of the Related Art

All conventional shuttle/array type ink-jet printers require control of temperature of ink to a predetermined level because, in current ink-jet printers, the ink suffers a change in viscosity due to the temperature of a head chip and the temperature of an ambient environment.

A change in viscosity of ink due to the temperature affects a drop volume of ink ejected from an ink-jet head chip and thus affects the quality of an image printed on a print medium such as paper, etc. For example, an amount of ink ejected, having decreased viscosity as the temperature increases, increases according to unit nozzles. Thus, an optical density of ink increases. On the contrary, the amount of ink ejected, having increased viscosity as the temperature decreases, is reduced according to unit nozzles. Thus, the optical density of ink decreases.

In addition, a result of repeated output in a high speed/high resolution mode causes a gradual temperature rise in an ink-jet head chip. At more than a predetermined temperature, the result of stabilized ejection cannot be predicted. Thus, at more than a predetermined temperature, time for stopping an operation and for reducing the temperature of the ink-jet head chip is required. In general, the environment in which a current ink-jet head chip is used, has a temperature between −20° C. to 40° C. When there is no additional control of repeated ejection in an ink-jet printer, the temperature inside the ink-jet head chip may continuously increase. Thus, in order to eject the amount of ink to a predetermined level of accuracy regardless of the ambient environment, a function of adjusting the ink-jet head chip within a predetermined range of temperature when ink is ejected is needed. In particular, in the case of a printer having a wide array head chip using an array type head chip (not a shuttle type head chip), the temperature between adjacent head chips is changed. A difference in temperature between adjacent head chips may cause remarkable image defects.

Thus, in the case of a printer using a wide array head chip, more precise temperature control is needed. To this end, a temperature sensor is used. As an example of a temperature sensor, a thermistor or a diode is used. The thermistor is used in a temperature sensing method using the principle that a change in resistance occurs according to temperature. However, a temperature sensor using a thermistor has a variation width of sensor resultant values and thus, sensor correction is needed. In addition, the temperature sensor using the thermistor has a drawback of the head chip having a large area. Meanwhile, a temperature sensor using a diode measures the temperature by a forward bias voltage being applied to a current supplied through an additional current source circuit and a voltage changing according to the temperature. However, in such a temperature sensor using a diode, an additional mask and an additional process must be additionally used when a monolithic type ink-jet head having an integrated complementary metal oxide semiconductor (CMOS) is designed or processed. In addition, a diode needs a predetermined area unlike a transistor which can be easily refined, and thus the diode occupies a large area of a silicon substrate.

In order to solve this problem, a metal oxide semiconductor field effect transistor (MOSFET) or a bipolar junction transistor (BJT) is used as a temperature sensor. In order to obtain a linear relationship between the temperature and the MOSFET, the MOSFET must operate in a weak channel inversion band. However, a leakage current and variations in process distortion and threshold voltage of the MOSFET at high temperatures are large. Thus, an additional correction operation is needed. In the BJT, a base-emitter junction potential indicates the linear characteristic of voltage/temperature. Thus, a bipolar CMOS (BiCMOS) having functions of a BJT type temperature sensor and a CMOS temperature sensor may be used. However, manufacturing costs of the BiCMOS are high.

SUMMARY OF THE INVENTION

The present general inventive concept provides an apparatus to sense the temperature of an ink-jet head to which a complementary metal oxide semiconductor (CMOS) lateral bipolar junction transistor (BJT) is applied as a temperature sensor so as to minimize a size of a sensor to sense the temperature of the ink-jet head.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an apparatus to sense the temperature of an ink-jet head, the apparatus including at least one or more CMOS (complementary metal oxide semiconductor) lateral BJTs (bipolar junction transistors) to sense the temperature of the ink-jet head, and a current supply unit to supply a current to the CMOS lateral BJTs.

The foregoing and/or other aspects and utilities of the general inventive concept may also be achieved by providing an inkjet image forming apparatus including one or more nozzles to emit ink to a recording medium, one or more ink feed holes to supply the ink to the nozzles, and at least one or more CMOS (complementary metal oxide semiconductor) lateral BJTs (bipolar junction transistors) to sense a temperature of the ink.

The ink may include a plurality of colors, and the CMOS lateral BJTs may sense the temperature of each of the respective colors of ink.

The at least one or more CMOS (complementary metal oxide semiconductor) lateral BJTs (bipolar junction transistors) may be disposed proximate to the one or more ink feed holes.

The at least one or more CMOS (complementary metal oxide semiconductor) lateral BJTs (bipolar junction transistors) may be disposed proximate to the one or more nozzles.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
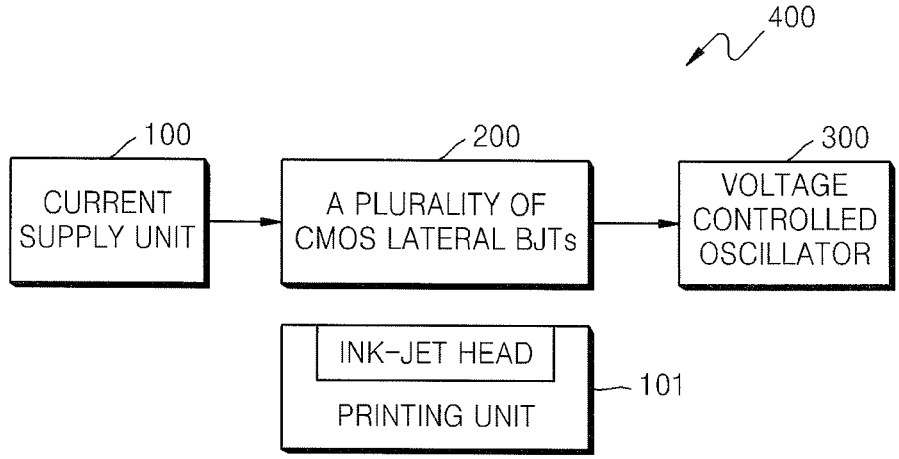
FIG. 1 is a block diagram illustrating an apparatus to sense the temperature of an ink-jet head according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an apparatus to sense temperature of an ink-jet head usable with an image forming apparatus 400 according to an embodiment of the present general inventive concept. Referring to FIG. 1, the apparatus to sense the temperature of the ink-jet head includes a current supply unit 100, a plurality of complementary metal oxide semiconductor (CMOS) lateral bipolar junction transistors (BJTs) 200, and a voltage controlled oscillator 300. The image forming apparatus 400 may further include a printing unit 101 to print an image on a print medium using the ink-jet head.

The current supply unit 100 supplies a current to each CMOS lateral BJT 200 so as to generate an operating bias in the plurality of CMOS lateral BJTs 200.

If the current is supplied to each of the CMOS lateral BJTs 200 from the current supply unit 100, the CMOS lateral BJTs 200 sense the temperature of the ink-jet head. According to an exemplary embodiment of the present general inventive concept, a CMOS type BJT in which a BJT is implemented using a CMOS manufacturing process, is used as a temperature sensor. In the CMOS type BJT, an advantage of a high switching speed is reduced. However, the CMOS type BJT has an excellent temperature characteristic of an existing BJT and can be manufactured using a CMOS process so that monolithic integration can be performed using a process such as a signal processing circuit. In the CMOS type BJT, there are a vertical method and a lateral method. However, in order to satisfy conditions of a chip size, the CMOS lateral type BJT is used in the present embodiments.

Figure 2:
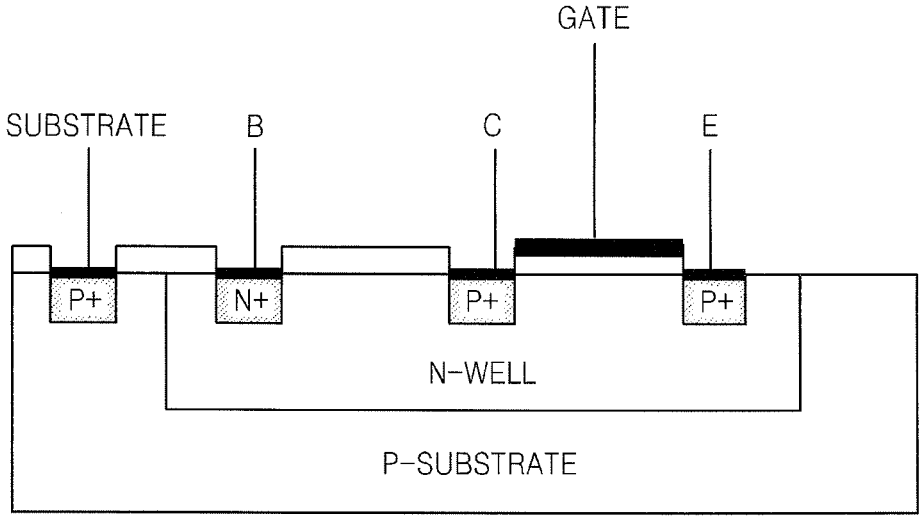
FIG. 2 is a cross-sectional concept view illustrating a complementary metal oxide semiconductor (CMOS) lateral bipolar junction transistor (BJT)

FIG. 2 is a cross-sectional concept view illustrating a CMOS lateral BJT. Comparing the sizes of a CMOS vertical BJT and the CMOS lateral BJT manufactured using a CMOS manufacturing process, the size of the CMOS lateral BJT is considerably smaller than that of the CMOS vertical BJT.

Figure 3:
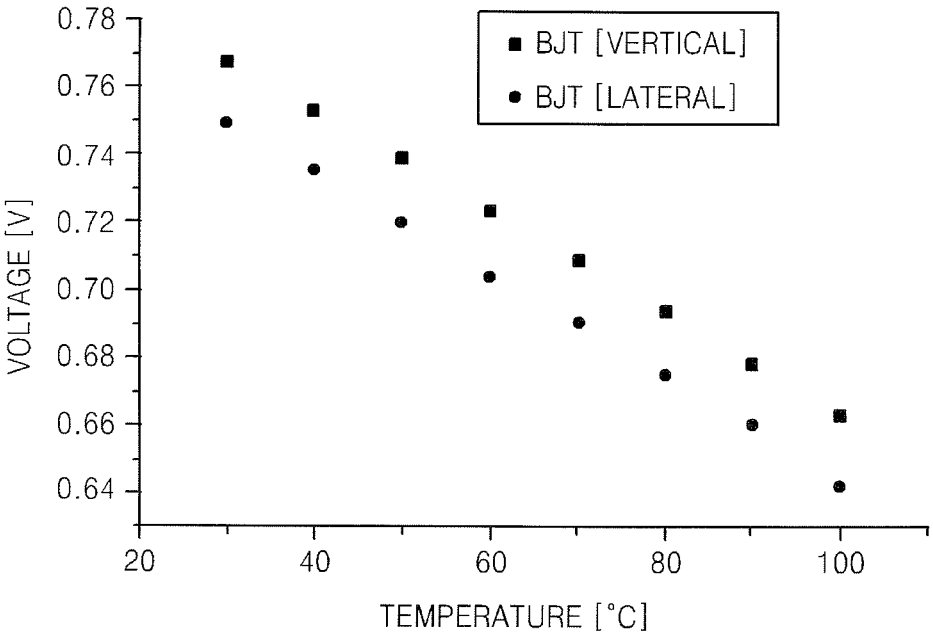
FIG. 3 is a graph illustrating linearity with respect to temperature sensing of a CMOS vertical BJT and a CMOS lateral BJT.

FIG. 3 is a graph illustrating linearity with respect to temperature sensing of a CMOS vertical BJT and a CMOS lateral BJT. In spite of a difference in the sizes of the CMOS vertical BJT and the CMOS lateral BJT, similar linearity is illustrated in FIG. 3. That is, the size of the CMOS lateral BJT can be reduced by ten times or more compared to that of the CMOS vertical BJT manufactured in the same way but has a same temperature resolution as the CMOS vertical BJT.

Figure 4:
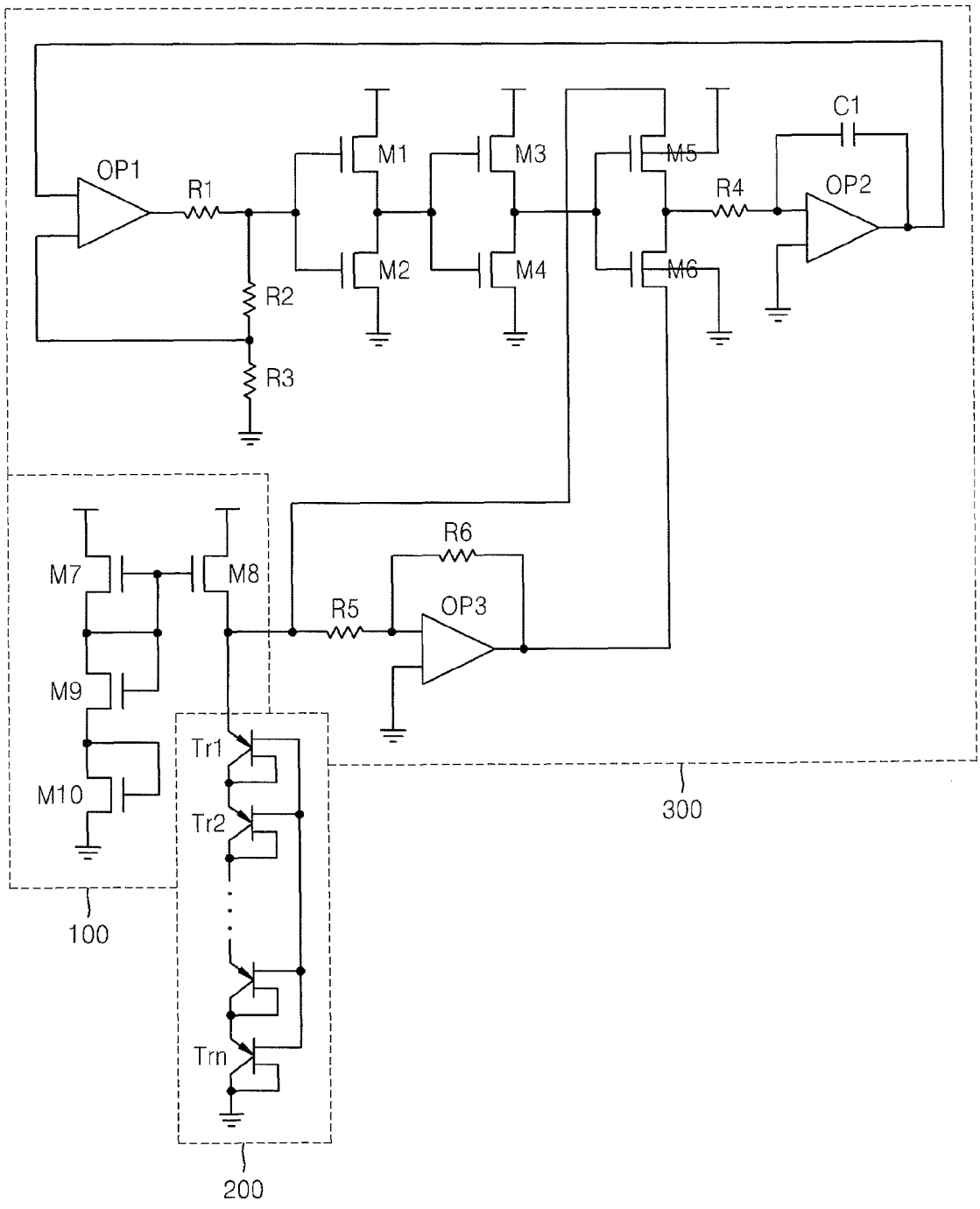
FIG. 4 is a circuit diagram illustrating an apparatus to sense the temperature of an ink-jet head according to an embodiment of the present general inventive concept.

FIG. 4 is a circuit diagram illustrating an apparatus to sense the temperature of an ink-jet head according to an embodiment of the present general inventive concept. As illustrated in FIG. 4, the plurality of CMOS lateral BJTs 200 (Tr1, Tr2, through to Trn) are connected to one another in series. The series-connected CMOS lateral BJTs 200 output a voltage that changes according to the temperature, to the voltage controlled oscillator 300 if a current is supplied to the CMOS lateral BJTs 200 from the current supply unit 100. The CMOS lateral BJTs 200 adjust a bias voltage so that a number of CMOS lateral BJTs 200 can vary from 1 to 8. The series-connected CMOS lateral BJTs 200 detect a change in an output voltage according to the temperature due to the number of CMOS lateral BJTs 200 connected in series so that the CMOS lateral BJTs 200 can be used to observe a change in temperature with high resolution. For example, when CMOS lateral BJTs positioned at each color of a chip including four colors such as black (K), cyan (C), magenta (M), and yellow (Y) colors, are connected in series to one another, temperature components of each of K, C, M, and Y colors are summed and output so that a resultant value can be obtained by adding widths of temperature change of each color.

Figure 5:
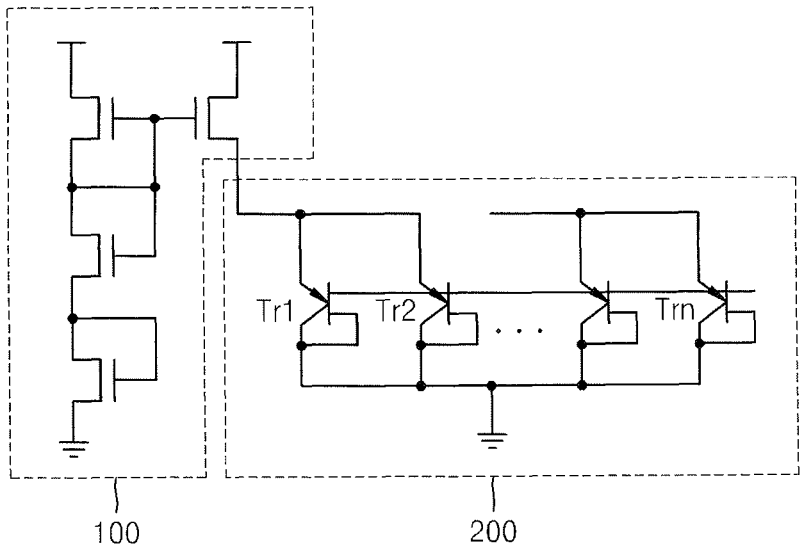
FIG. 5 illustrates a plurality of CMOS lateral BJTs that are connected to one another in parallel according to an embodiment of the present general inventive concept.

FIG. 5 illustrates a plurality of CMOS lateral BJTs that are connected to one another in parallel. As illustrated in FIG. 5, a plurality of parallel-connected CMOS BJTs 200 (Tr1, Tr2, through to Trn) are disposed in allocated positions thereof according to colors of an ink-jet head. The plurality of parallel-connected CMOS lateral BJTs 200 are positioned according to colors and may sense a change in inks and a change in temperature of a local chip according to colors. For example, when the CMOS lateral BJTs 200 positioned in each color are connected in parallel to a chip including of four colors such as K, C, M, and Y colors, each temperature value of each of K, C, M, and Y colors can be detected.

Figure 6:
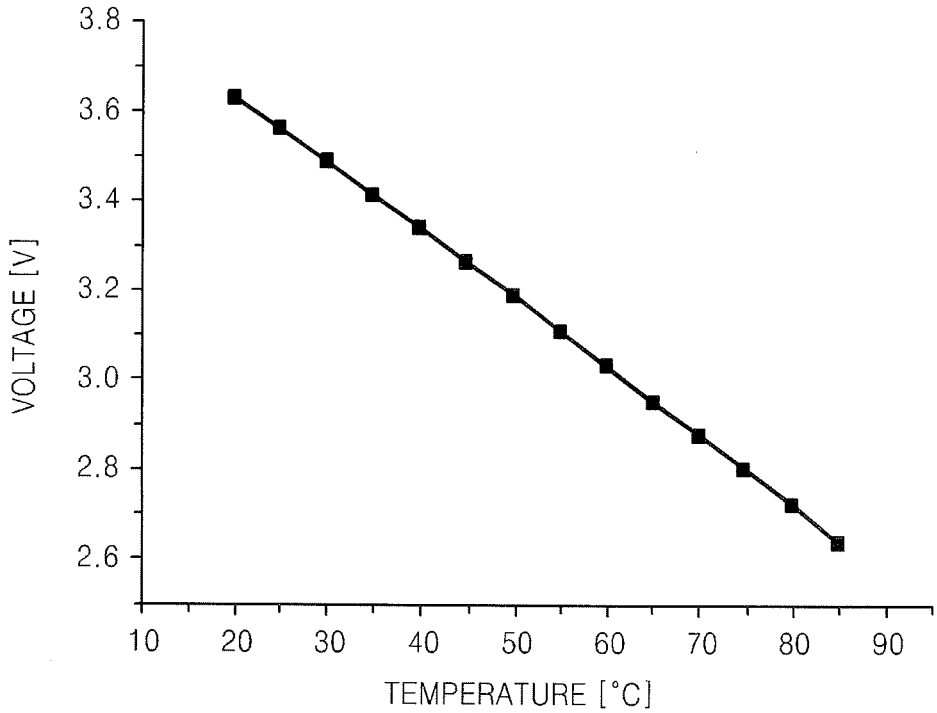
FIG. 6 is a graph illustrating the result of measuring a DC voltage measured by a plurality of CMOS lateral BJTs.

FIG. 6 is a graph illustrating a result of measuring a DC voltage measured by a plurality of CMOS lateral BJTs. Sensitivity of 16 [mV/° C.] and a linearity error less than 1% are illustrated in FIG. 6.

The plurality of CMOS lateral BJTs 200 are disposed adjacent to a feed hole of the ink-jet head. The plurality of CMOS lateral BJTs 200 may be positioned at right and left ends of the feed hole to supply each color ink. The CMOS lateral BJTs 200 are sufficiently small so that an additional space for a temperature sensor is not needed. The CMOS lateral BJTs 200 may be positioned near an individual nozzle and may sense the temperature of the individual nozzle.

The voltage controlled oscillator 300 converts a voltage output from the CMOS lateral BJT 200 according to a temperature change into a frequency signal and outputs the frequency signal. To this end, the voltage controlled oscillator 300 includes a buffer, a Schmidt trigger, an RC integrator, and a CMOS voltage divider, as illustrated in FIG. 4. The voltage controlled oscillator 300 converts a DC voltage sensed by the CMOS lateral BJTs 200 into a frequency component so that signal processing can be easily performed.

Figure 7:
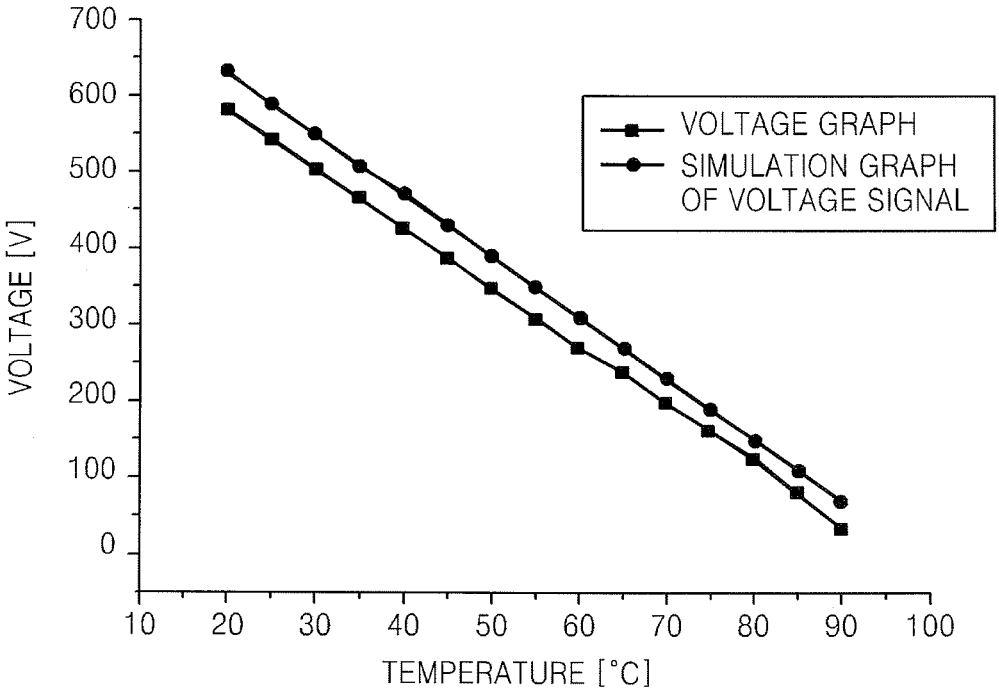
FIG. 7 is a graph illustrating an example in which a voltage signal is converted into a frequency signal using a voltage controlled oscillator.

FIG. 7 is a graph illustrating an example in which a voltage signal is converted into a frequency signal by using a voltage controlled oscillator. As illustrated in FIG. 7, a simulation graph of the voltage signal is similar to the graph of a converted frequency signal.

The apparatus to sense the temperature of the ink-jet head according to an exemplary embodiment of the present general inventive concept can be used in an image forming apparatus having a wide array ink-jet head. The apparatus to sense the temperature of the ink-jet head is used in the image forming apparatus having the wide array ink-jet head, in order to minimize a defect related to image output due to a difference in temperature between adjacent head chips.

According to the present embodiment, the CMOS lateral BJTs are used as a temperature sensor so that linearity in temperature sensing can be obtained. Since the sizes of the CMOS lateral BJTs can be reduced, additional space for a temperature sensor within the ink-jet head is not required.

In addition, the plurality of CMOS lateral BJTs are connected in series or in parallel so that sensitivity or a temperature information value related to position can be adjusted. That is, the CMOS lateral BJTs are connected in series in order to increase sensitivity with respect to the temperature so that sensitivity of each BJT increases and high resolution with respect to the temperature can be obtained. Meanwhile, the plurality of the CMOS lateral BJTs are connected in parallel in order to extract individual temperature information about each object.

In addition, results obtained by the temperature sensor are converted into a frequency signal so that digital processing can be easily performed.

While the present general inventive concept has been particularly illustrated and described with reference to exemplary embodiments thereof, it will be understood by one of ordinary skill in the art that various changes in form and details may be made therein without departing from the spirit and scope of the present general inventive concept as defined by the following claims.

What is claimed is:

1. An apparatus to sense the temperature of an ink-jet head, the apparatus comprising:

plurality of CMOS (complementary metal oxide semiconductor) lateral BJTs (bipolar junction transistors) to directly sense the temperature of the ink-jet head; and a current supply unit to supply a current to the CMOS lateral BJTs to generate an operating bias in the at least one CMOS lateral BJTs.

2. The apparatus of claim 1, wherein the at least one or more CMOS lateral BJTs comprise a plurality of CMOS lateral BJTs that are connected to one another in parallel.

3. The apparatus of claim 1, wherein the a plurality of CMOS lateral BJTs are connected to one another in series.

4. The apparatus of claim 1, wherein the at least one or more CMOS lateral BJTs are disposed adjacent to a feed hole of the ink-jet head.

5. The apparatus of claim 1, wherein the ink-jet head is a wide array head.

6. The apparatus of claim 1, further comprising:

a voltage controlled oscillator to convert a voltage output from the CMOS lateral BJTs according to a temperature change into a frequency signal and to output the frequency signal.

7. The apparatus of claim 6, wherein the voltage controlled oscillator comprises:

a buffer, a Schmidt trigger, an RC integrator, and a CMOS voltage divider.

8. An inkjet image forming apparatus, comprising:

one or more nozzles to emit ink to a recording medium;

one or more ink feed holes to supply the ink to the nozzles; and a plurality of CMOS (complementary metal oxide semiconductor) lateral BJTs (bipolar junction transistors) to directly sense a temperature of the ink.

9. The inkjet image forming apparatus of claim 8, wherein the ink comprises:

a plurality of colors, and the CMOS lateral BJTs sense the temperature of each of the respective colors of ink.

10. The inkjet image forming apparatus of claim 8, wherein the at least one or more CMOS (complementary metal oxide semiconductor) lateral BJTs (bipolar junction transistors) are disposed proximate to the one or more ink feed holes.

11. The inkjet image forming apparatus of claim 8, wherein the at least one or more CMOS (complementary metal oxide semiconductor) lateral BJTs (bipolar junction transistors) are disposed proximate to the one or more nozzles.

12. The apparatus of claim 1, wherein the at least one CMOS lateral BJTs are positioned at each of a plurality of ink colors of the ink-jet head such that a temperature value of each of the plurality of ink colors can be detected.

13. The inkjet forming apparatus of claim 8, wherein the at least one CMOS lateral BJTs are positioned at each of a plurality of ink colors of the ink-jet head such that a temperature value of each of the plurality of ink colors can be detected.

* * * * *